US008505729B2

(12) United States Patent
Sosnovsky et al.

(10) Patent No.: US 8,505,729 B2
(45) Date of Patent: Aug. 13, 2013

(54) CONTAINER

(75) Inventors: David Sosnovsky, Tel Aviv (IL); Mark Bensman, Rosh Ha'Ayin (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 283 days.

(21) Appl. No.: 12/954,125

(22) Filed: Nov. 24, 2010

(65) Prior Publication Data

US 2011/0139666 A1 Jun. 16, 2011

Related U.S. Application Data

(63) Continuation-in-part of application No. 12/636,139, filed on Dec. 11, 2009, now abandoned.

(51) Int. Cl.
*B65D 21/00* (2006.01)

(52) U.S. Cl.
USPC ..... 206/508; 220/4.26; 220/4.27; 220/23.6; 220/23.83; 220/324; 220/752; 220/754; 220/756; 220/810; 206/503; 206/504; 206/509; 206/511

(58) Field of Classification Search
USPC ..... 220/4.26, 4.27, 23.6, 23.83, 23.86, 220/324, 752, 754, 756, 810; 206/503, 504, 206/508, 509, 511
See application file for complete search history.

(56) References Cited

U.S. PATENT DOCUMENTS

| | | | |
|---|---|---|---|
| 1,933,894 | A | 11/1933 | Clink |
| 3,310,905 | A | 3/1967 | Davis et al. |
| 3,327,841 | A | 6/1967 | Schurman et al. |
| 4,619,363 | A | 10/1986 | Wolfseder |
| 4,836,374 | A | 6/1989 | Hutchins et al. |
| 4,927,021 | A | 5/1990 | Taylor |
| 5,022,546 | A | 6/1991 | Bock |
| 5,325,966 | A | 7/1994 | Chang |
| 5,699,925 | A | 12/1997 | Petruzzi |
| 5,803,254 | A | 9/1998 | Vasudeva |
| 5,882,097 | A | 3/1999 | Kohagen et al. |

(Continued)

FOREIGN PATENT DOCUMENTS

| | | | |
|---|---|---|---|
| DE | 29900082 | U1 | 4/1999 |
| DE | 20104108 | U1 | 6/2001 |
| DE | 102007032382 | A1 | 1/2008 |
| WO | WO 02/11955 | A1 | 2/2002 |

OTHER PUBLICATIONS

Extended Search Report as issued for European Patent Application No. 10193990.8, dated Jun. 16, 2011.

*Primary Examiner* — Anthony Stashick
*Assistant Examiner* — Elizabeth Volz
(74) *Attorney, Agent, or Firm* — Pillsbury Winthrop Shaw Pittman LLP

(57) ABSTRACT

A container constructed and arranged to be connected to at least one other container. The container has a container portion, a cover, and a latch member movable between a first position and a second position. A retaining member on the container portion is engageable with the latch member. In the first position, the latch member engages the retaining member to inhibit movement of the latch member away from the first position. In the second position, the latch member is engageable with a container portion of the other container to connect the containers. The latch member is pivotally movable in a clockwise and counterclockwise manner. The latch member can be pivoted upwards to the second position to engage the other container and the latch member can be pivoted downwards to the first position to engage the retaining member to inhibit movement of the latch member away from the first position.

15 Claims, 12 Drawing Sheets

(56) References Cited

U.S. PATENT DOCUMENTS

| | | | |
|---|---|---|---|
| 5,887,715 | A | 3/1999 | Vasudeva |
| 5,915,554 | A | 6/1999 | Hung |
| 5,934,466 | A | 8/1999 | Loeffler |
| D417,338 | S | 12/1999 | Main |
| 6,015,064 | A | 1/2000 | Liu |
| 6,082,539 | A | 7/2000 | Lee |
| 6,105,767 | A | 8/2000 | Vasudeva |
| 6,371,320 | B2 | 4/2002 | Sagol |
| 6,523,687 | B2 | 2/2003 | Ling |
| 6,626,295 | B1 | 9/2003 | Vasudeva |
| 6,648,166 | B2 | 11/2003 | Levy |
| 6,889,838 | B2 | 5/2005 | Meier et al. |
| 6,971,517 | B2 | 12/2005 | Chen |
| 6,994,214 | B2 | 2/2006 | Yang |
| D536,525 | S | 2/2007 | Vasudeva et al. |
| 7,219,969 | B2 | 5/2007 | Bezzubov |
| 7,246,704 | B2 | 7/2007 | Brunson et al. |
| 7,255,229 | B2 | 8/2007 | Roesler |
| 7,334,680 | B2 | 2/2008 | Cunningham et al. |
| 7,357,268 | B2 | 4/2008 | Yang |
| 7,472,730 | B2 | 1/2009 | Adkins |
| 7,523,827 | B2 | 4/2009 | Dane et al. |
| 2004/0069668 | A1 | 4/2004 | Finnigan |
| 2005/0161357 | A1 | 7/2005 | Allan et al. |
| 2005/0224384 | A1 | 10/2005 | Sands et al. |
| 2006/0037964 | A1 | 2/2006 | Su |
| 2007/0103039 | A1 | 5/2007 | Holcomb et al. |
| 2007/0194024 | A1 | 8/2007 | Liaw |
| 2009/0236255 | A1 | 9/2009 | Piacenza |

CONTAINER

FIELD OF THE INVENTION

The present invention relates to a container storage system, and more particularly, to a container storage system having containers that can be connected together.

BACKGROUND OF THE INVENTION

Numerous container storage systems are known in the art. However, there is a constant need in the industry to improve upon existing container storage systems by making them more efficient, easy to use, modular, and/or multifunctional.

SUMMARY OF THE INVENTION

One aspect provides a container constructed and arranged to be connected to at least one other container. The container has a container portion with an opening into an interior space in which articles to be transported can be stored and a cover for closing the opening. The container also includes a latch member movable between a first position and a second position. A retaining member on the container portion is constructed and arranged to engage with the latch member. In the first position, the latch member engages the retaining member to inhibit movement of the latch member away from the first position. The latch member, when in the second position, is positioned to be able to engage with a container portion of the at least one other container to connect the container to the at least one other container. The latch member is pivotally movable in a clockwise and counterclockwise manner. The latch member can be pivoted upwards to the second position to engage the container portion of the at least one other container and the latch member can be pivoted downwards to the first position to engage the retaining member to inhibit movement of the latch member away from the first position.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the structural components illustrated herein can be considered drawn to scale. It is to be expressly understood, however, that the drawings are for the purpose of illustration and description only and are not a limitation of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

DETAILED DESCRIPTION OF THE INVENTION

Figure 1:
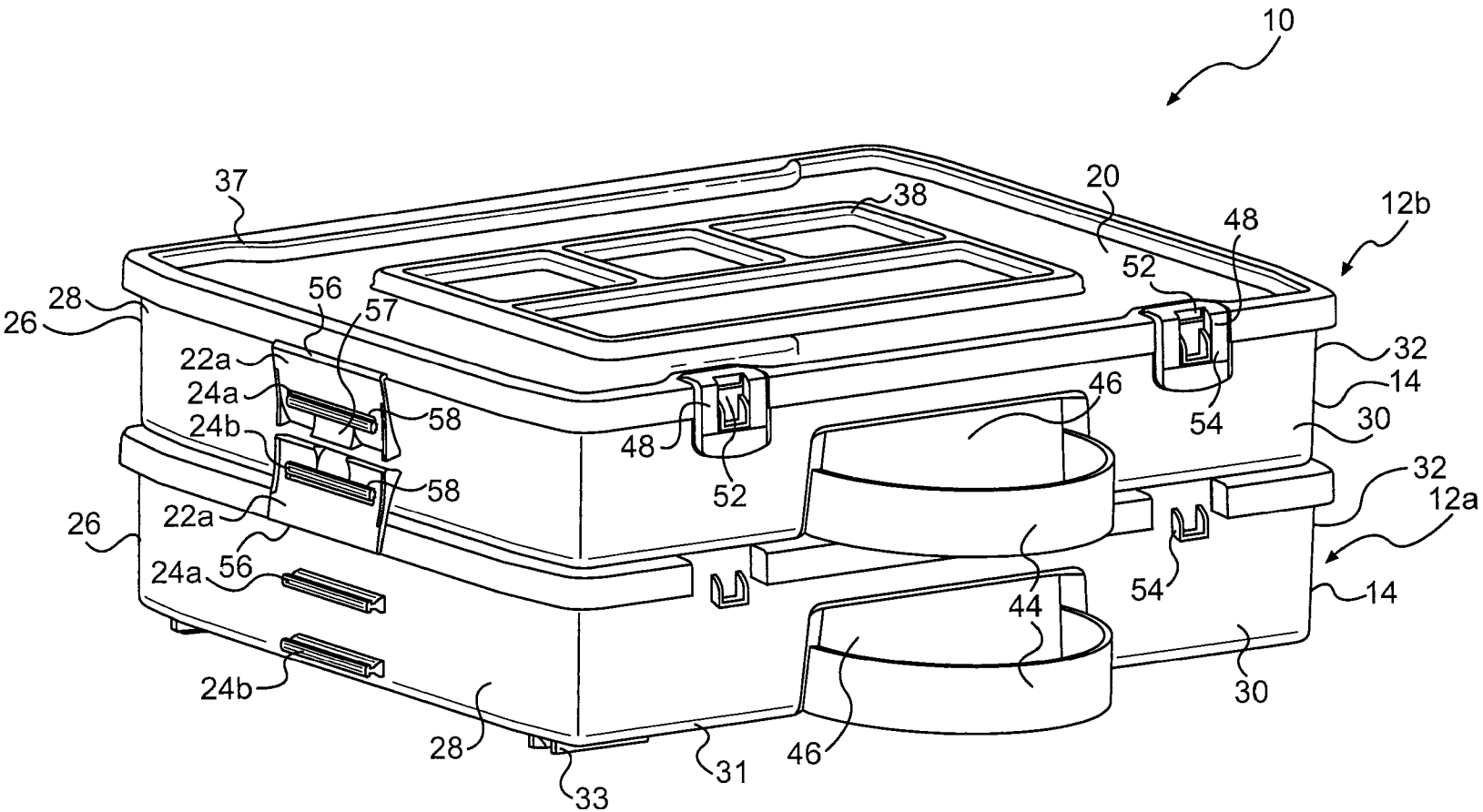
FIG. 1 is a perspective front view of a container storage assembly in accordance with an embodiment of the present invention.
Figure 4:
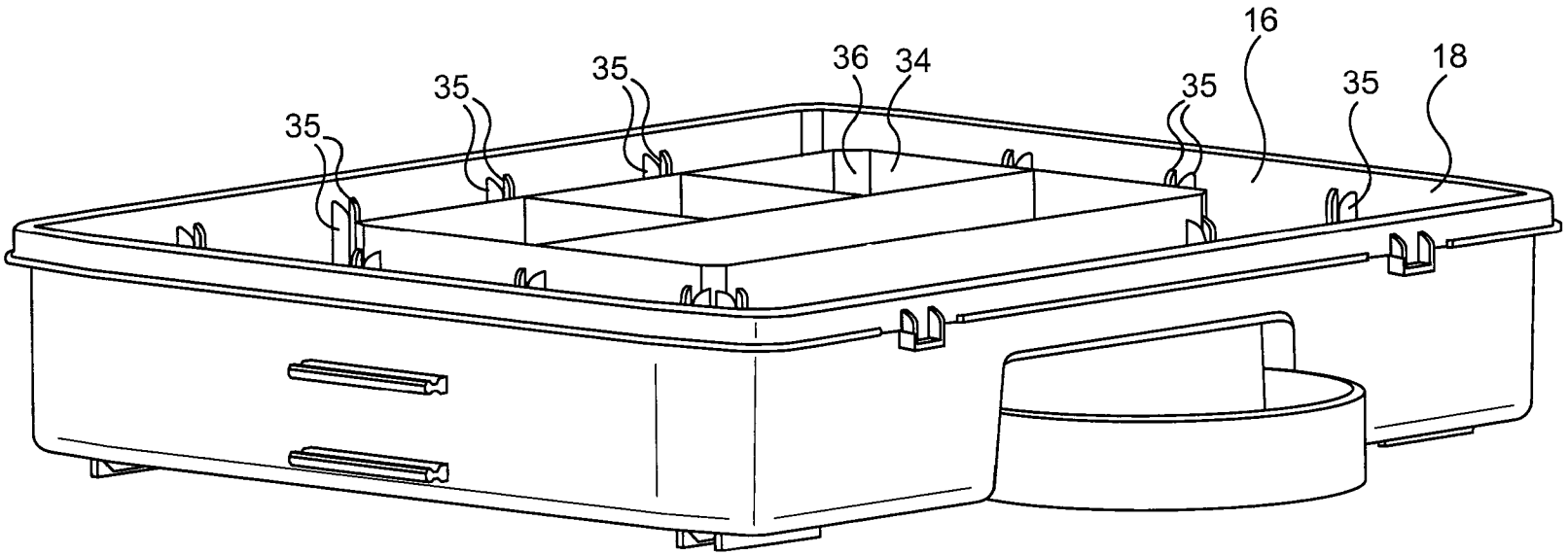
FIG. 4 is a perspective front view of a container of the container storage assembly in accordance with the embodiment of FIG. 1.

FIG. 1 shows a container storage system 10 that includes a plurality of containers 12*a*, 12*b* constructed and arranged to be connected together. Each container 12*a* or 12*b* has a container portion 14 with an opening 16 (see FIG. 4) into an interior space 18 in which articles to be transported can be stored. Each container 12*a* or 12*b* also includes a cover 20 for closing the opening and a latch member 22*a* that is moveable between a first position and a second position. Each container 12*a* or 12*b* also has a retaining member or latch receiving portion 24*a* or 24*b* constructed and arranged to engage with the latch member 22*a*. In the first position, the latch member 22*a* engages the retaining member 24*b* to inhibit movement of the latch member away from the first position. In the second position, the latch member 22*a* of a first of the containers 12*a* engages with a second of the containers 12*b* to connect the first container 12*a* to the second container 12*b*. Although FIG. 1 only shows two containers 12*a* and 12*b* of the container storage system 10, additional containers that are constructed and arranged similarly to containers 12*a* and 12*b* may be connected to containers 12*a* and 12*b*. It is also contemplated that additional containers constructed and arranged differently from containers 12*a* and 12*b* may be connected to containers 12*a* and 12*b*. The containers 12*a* and 12*b* are generally rectangular in shape. However, any convenient shape may be used.

As shown in FIG. 1, the interior space 18 (see FIG. 4) of the container portion 14 of each container 12*a* and 12*b* may be defined by a back wall or side 26, a left wall or side 28, a front wall or side 30, a bottom wall or side 31, and a right wall or side 32. The interior space 18 may include dividers or inserts 34 (see FIG. 4) constructed and arranged to divide the interior space into compartments 36. The dividers 34 may be constructed and arranged to be optionally removable by the user so that the user can insert the dividers 34 at various positions to form various sized compartments. The interior space 18 may also include pairs of flanges 35 (see FIG. 4) constructed and arranged to extend from the back wall 26, the left wall 28, the front wall 30, and the right wall 32 at different angles so as to form a V shape. The flanges 35 may have the same height as the dividers 34, or may be of a greater or smaller height.

The flanges 35 may be constructed and arranged to receive ribs (not shown) on the dividers 34. In one embodiment, the dividers 34 form the side walls of boxes or container members with open tops that can be inserted into the container portion 14. As such, these containers or boxes formed by the dividers 34 may have ribs along their edges, wherein the ribs may be inserted into these flanges 35 so as to retain the containers or boxes within the container portion 14. These containers or boxes formed by the dividers 34 may be used to carry items, such as, for example, nails, screws, or other small items. It is also contemplated that these containers or boxes may be removed from the containers 12*a*, 12*b* to be carried separately. The container portion 14 may be made of plastic, metal, wood, other materials, or a combination thereof. The containers 12*a* and 12*b* may have feet 33 attached to the bottom wall 31 that are constructed and arranged to engage a surface. The feet 33 may be made of plastic, rubber, or other materials to provide friction with the surface on which the container 12*a* or 12*b* is resting.

Figure 3:
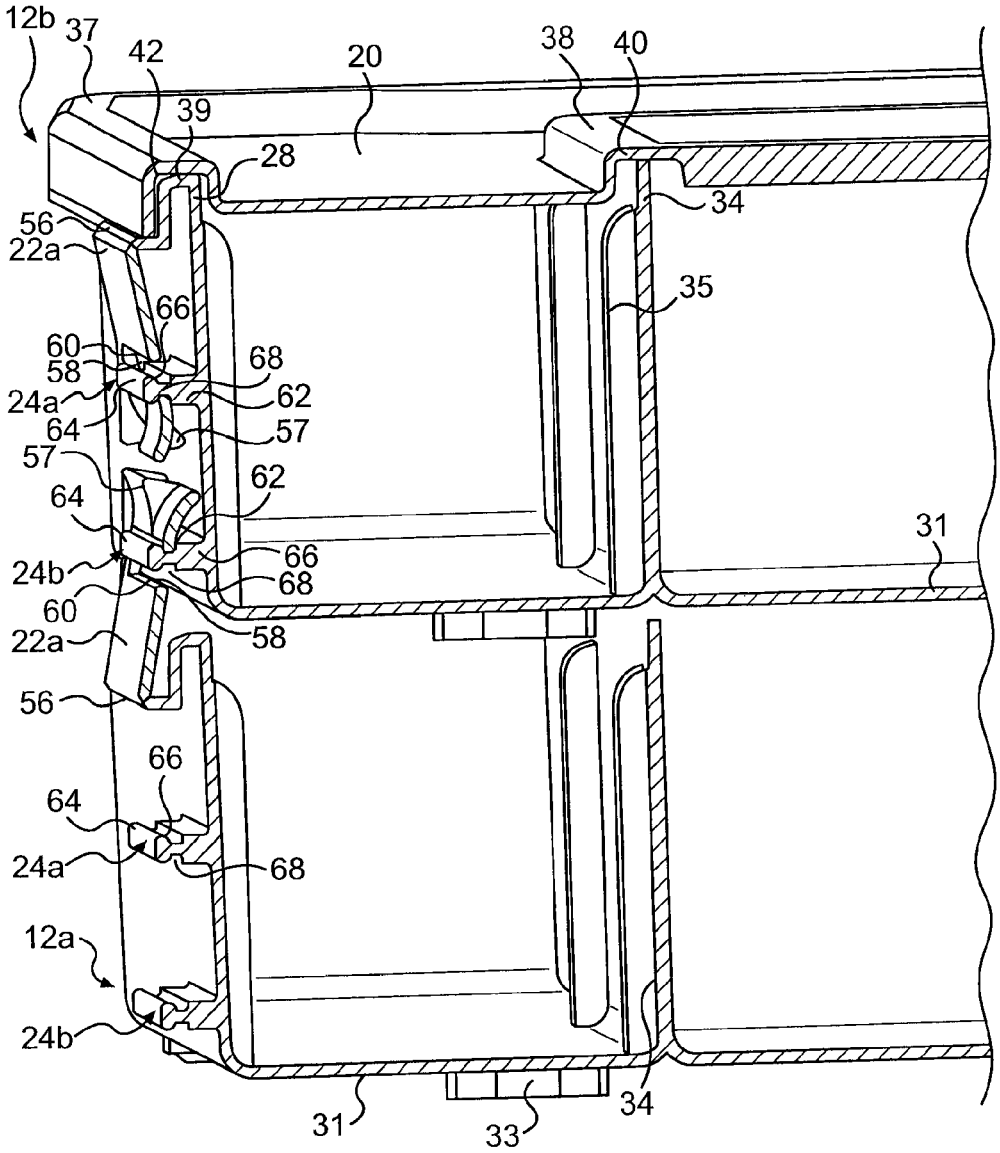
FIG. 3 is a cross-sectional view of the container storage assembly in accordance with the embodiment of FIG. 1.

As shown in FIG. 1, periphery ridges 37 may be provided on the periphery of the cover 20. The periphery ridges 37 may be constructed and arranged to abut against the top portions 39 of the back wall 26, the left wall 28, the front wall 30, and the right wall 32 (see FIG. 3). As shown in FIG. 3, the top portion 39 of the left wall 28 may be constructed and arranged to fold outwardly to form a U-shape. As such, the inner portion 42 of the periphery ridges 38 may abut against at least a portion of the U-shaped top portion 39. The top portions 39 of the back wall 26, the front wall 30, and the right wall 32 may be constructed and arranged in a similar manner as the top portion 39 of the left wall 28. The top portions 39 may optionally have other constructions and arrangements.

In the embodiment shown in FIG. 1, the top surface of the cover 20 also includes center ridges 38. The inner portion 40 of the center ridges 38 may be constructed and arranged to abut against the dividers 34 when the cover is in the closed position, as shown in FIG. 3. As such, the cover 20 of the first container 12*a* may be reinforced by the ridges 37 and 38 and their abutment with the top portions 39 of the back wall 26, the left wall 28, the front wall 30, and the right wall 32 and the dividers 34, respectively, when the second container 12*b* is stacked on top of the first container 12*a*. Alternatively, in one embodiment, the inner portion 40 of the ridges 38 are constructed and arranged to be positioned at a minimal distance above the dividers 34 when the cover 20 is initially in the closed position, but may abut against the dividers 34 when heavy objects are placed on top of the cover 20 to cause the cover 20 to depress downward. The center ridges 38 may optionally have different locations or arrangements.

Figure 8:
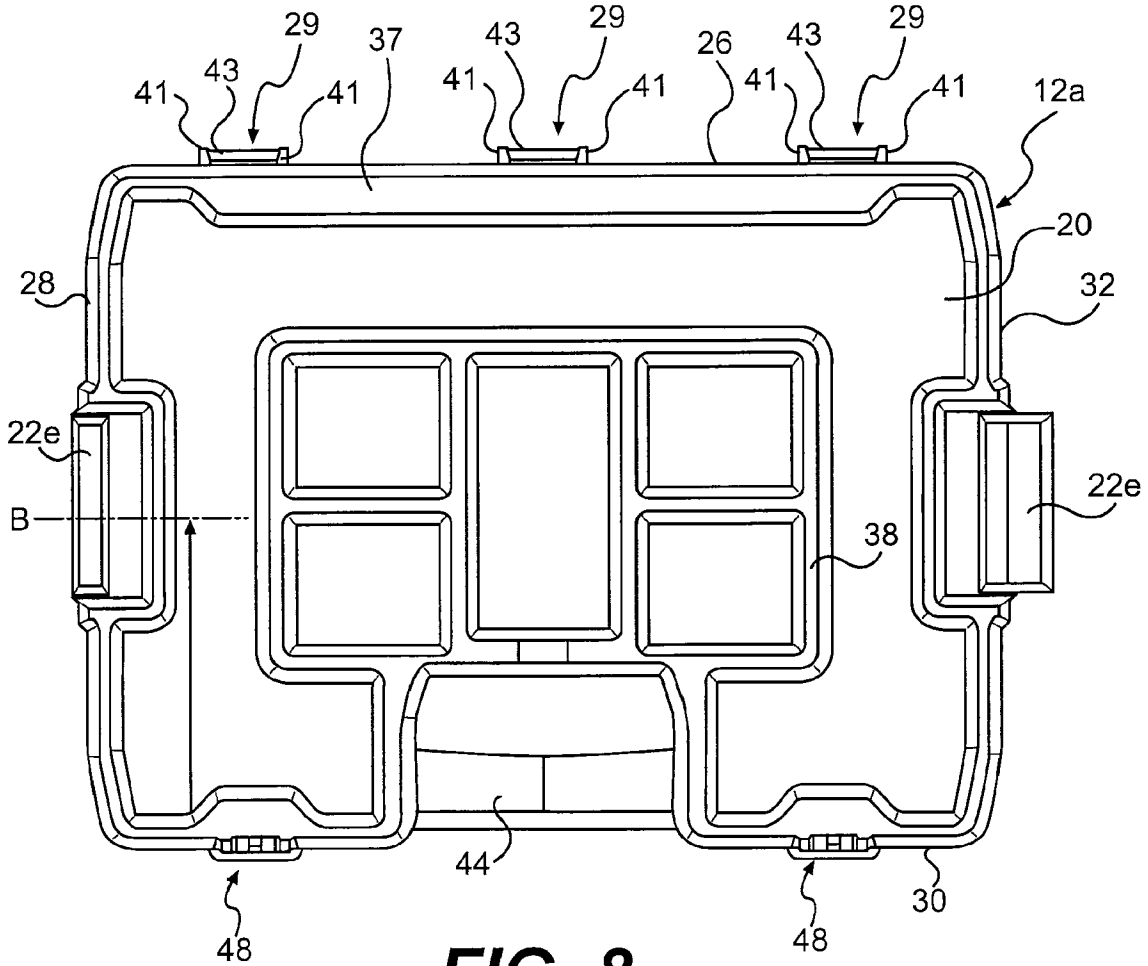
FIG. 8 is a top view of the container storage assembly in accordance with the embodiment of FIG. 7.

In one embodiment, each of the containers 12*a* and 12*b* of the container storage system 10 includes a cover 20 when the containers 12*a* and 12*b* are connected. The cover 20 of any of the containers 12*a* and 12*b* may optionally be removed such that both, one, or none of the containers 12*a* and 12*b* have covers 20 when the containers 12*a* and 12*b* are connected. The cover 20 may be pivotally connected to the container portion 14 using hinges, pins, screws, fastenings, bolts, or any other connecting mechanism as would be appreciated by one skilled in the art. In one embodiment wherein hinges 29 are used to pivotally connect the cover 20 to the container portion 14, the hinges 29 are constructed and arranged to extend from the rear wall 26 of the container portion 14 (see FIG. 8). The hinges 29 may also be constructed and arranged to be detachable so that the cover 20 can be detached and removed from the container portion 14. For example, in FIG. 8, each hinge 29 includes side portions 41 that are pivotally engaged with a middle portion 43. The side portions 41 of the hinges 29 may be connected to the container portion 14 and the middle portion 43 of the hinges 29 may be connected to the cover 20. As such, the middle portion 43 of the hinges 29 may be disconnected from the side portions 41 of the hinges 29 so that the cover 20 can be detached and removed from the container portion 14. Any conventional types of hinges may optionally be used. The cover 20 may also be a slide-on cover which is slid on to container portion 14 or a snap-on cover that is snapped on to the container portion 14. It is contemplated that the methods of mounting the lid 14 on to the container portion 14 may vary and the number of covers 20 may vary. For example, there may be two covers 20 pivotally connected to the container portion 14 wherein each cover 20 may be opened or closed independently of the other. The cover 20 may be made of plastic, metal, wood, other materials, or a combination thereof. It is contemplated that all or any of the parts of the container 10 may be made from a molded plastic material.

In the embodiment shown in FIG. 1, each of the containers 12*a* and 12*b* includes a handle 44 constructed and arranged to enable a user to lift the container 12*a* or 12*b*. A depression 46 may be formed between the front wall 30 and the handle 44 to allow better access to the handle 44. In one embodiment, the handle 44 may be made of a flexible material, such as, for example, elastomer, rubber or plastic. The handle 44 may be a curved arc, such as shown in FIG. 1, or may have other shapes (see FIG. 5). In another embodiment, the handle 44 may be a rigid and fixed handle. In some embodiments, the handle 44 may be pivotally connected to the containers 12*a* and 12*b* via hinges, pins, screws, fastenings, bolts, or any other connecting mechanism as would be appreciated by one skilled in the art.

Figure 5:
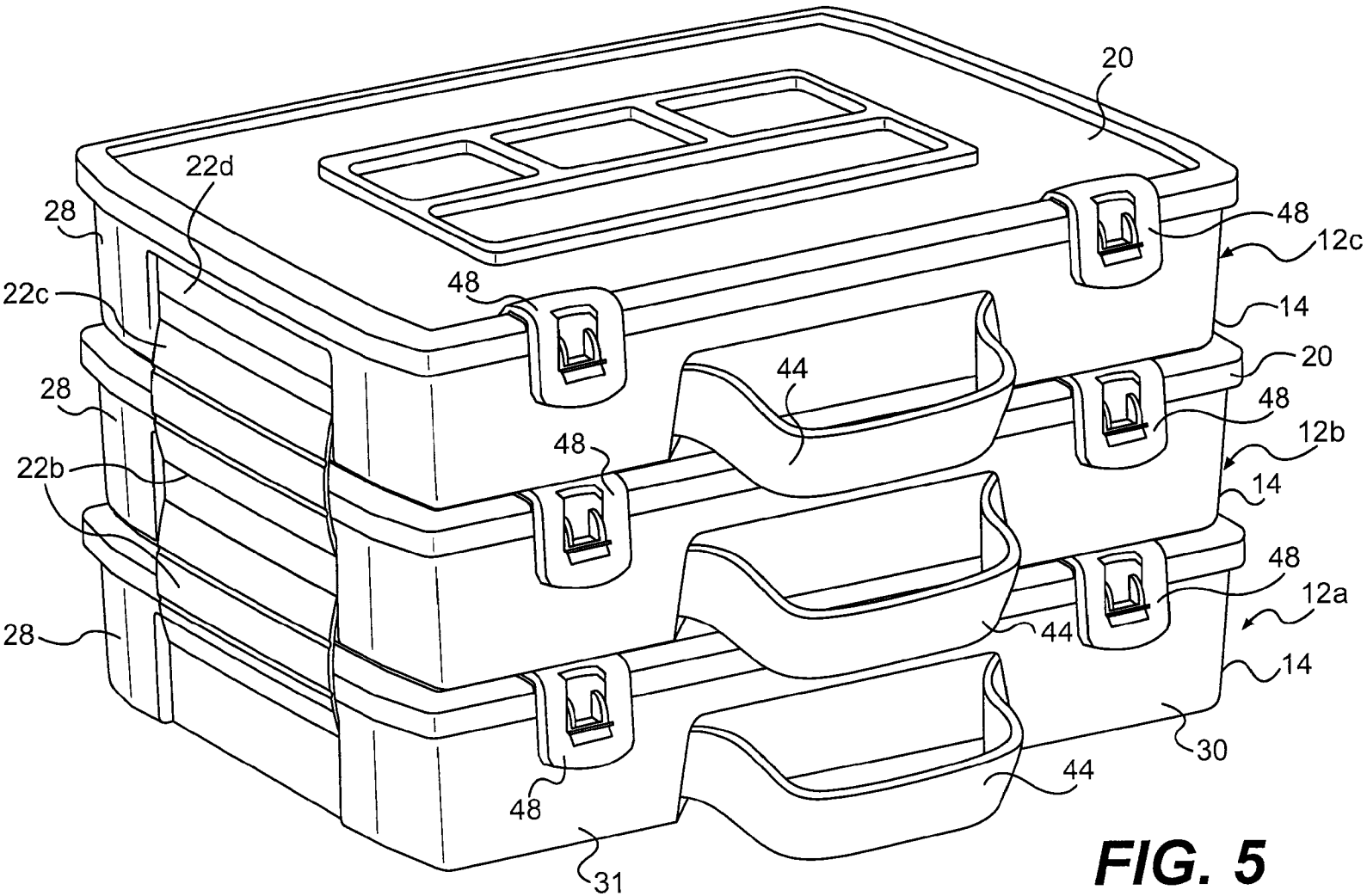
FIG. 5 is a perspective front view of the container storage assembly in accordance with another embodiment of the present invention.

Each of the containers 12*a* and 12*b* may include a cover latch or latch mechanism 48 constructed and arranged to latch the cover 18 to the container portion 14. In the embodiment shown in FIG. 1, the container 12*b* includes a pair of snap-on cover latches 48. Although FIG. 1 shows only container 12*a* as having cover latches 48, it is contemplated that all of the containers 12*a*, 12*b*, 12*c* may have cover latches 48 when they are connected to each other, as shown in FIG. 5. The cover latch 48 may be integrally formed with the cover 20 (e.g., as a living hinge) or may be a separate piece connected to the cover 20. The cover latch 48 may be constructed and arranged to extend downwardly and generally perpendicular to the plane of the cover 20. In another embodiment, the cover latch 48 is pivotally connected to the container portion, and can secure the cover 20 by engaging a latch receiving portion on the cover. An opening 52 may be formed in the cover latch 48 and may be constructed and arranged to engage with a latch engaging element 54, which takes the form of a protrusion in FIG. 1, on the container portion 14, so as to latch the cover 20 to the container portion 14. To latch the cover 20 to the container portion 14, the user may simply push down the cover 20 towards the container portion 14 so that the protrusion 54 slides against the surface of the cover latch 48 until the protrusion 54 snaps into the opening 52. To unlatch the cover 20, the user may simply pull the cover latch 48 in a direction away from the protrusion 54 so that the protrusion is no longer engaged with the opening 52. The user may then lift the cover 20 to the open position. It is contemplated that the location of the protrusion 54 and the opening 52 may be switched so that the protrusion 54 is located on the cover 20 and the opening 52, which may also take the form of a depression, is located on the container portion 14. It is also contemplated that the configuration and number of cover latches 48 may vary in other embodiments. For example, the cover latch 48 may be one or more pivotable latches, buckles, or other latching mechanism. In another embodiment, the latch 48 is linearly slidable rather than pivotable.

In the embodiment shown in FIG. 1, each of the containers include the upper retaining member or upper latch receiving portion 24*a* and the lower retaining member or lower latch receiving portion 24*b*. Each of the containers 12*a* and 12*b* also includes the pivotal latch member 22*a* that may be pivoted between the first position, where the latch member 22*a* engages the upper retaining member 24*a* to inhibit pivotal movement of the latch member 22*a* away from the first position, and the second position, where the latch member 22*a* of one of the containers 12*a* and 12*b* engages with the lower retaining member 24*b* of another one of the containers 12*a* and 12*b* to connect the containers 12*a* and 12*b*. The latch member 22*a* may be in the first position when the latch member 22*a* is not being used to connect the containers 12*a* and 12*b*. The latch member 22*a* may be in the second position when the latch member 22*a* is being used to connect the containers 12*a* and 12*b*. As shown in FIG. 1, the latch member 22*a* may be pivotably connected to the container portion 14 of each container 12*a* and 12*b* via a living hinge 56. It is contemplated that the latch member 22*a* may be connected to other parts of the container 12*a* or 12*b*, such as the cover 20. It is also contemplated that the latch member 22*a* may be pivotably connected to the cover 20 or container portion 14 via hinges, pins, screws, fastenings, bolts, or any other connecting mechanism. In the embodiment shown in FIG. 1, the retaining members 24*a* and 24*b* and the latch member 22*a* are connected to the left wall 28 and the right wall 32 of the container portion 14. However, the retaining members 24*a* and 24*b* and the latch member 22*a* may be positioned at other locations, such as, for example, the back wall 26 and the front wall 30. It is contemplated that there may be retaining members 24*a* and 24*b* and latch members 22*a* on all or any combination of the back wall 26, left wall 28, front wall 30, and right wall 32.

Figure 2:
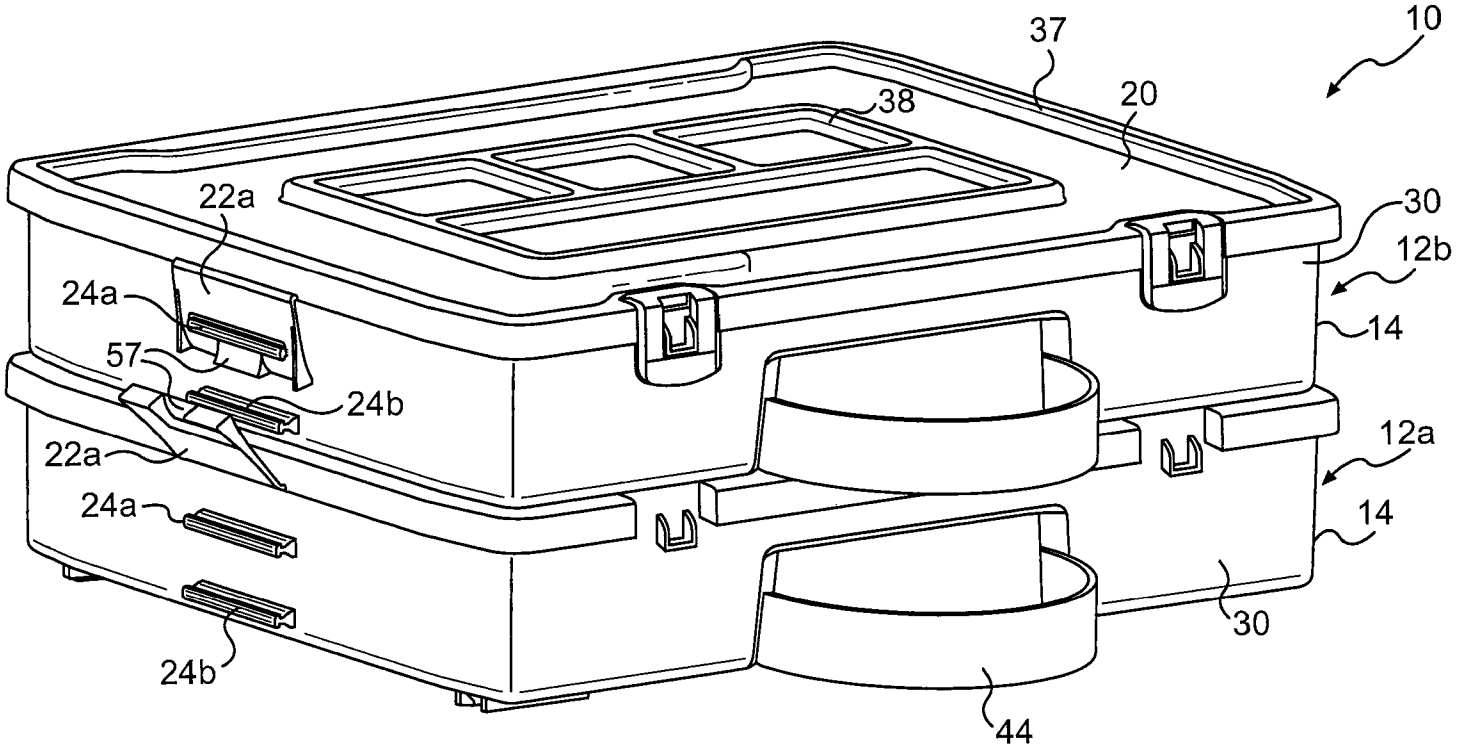
FIG. 2 is a perspective front view of a container storage assembly in accordance with the embodiment shown in FIG. 1.

To disconnect the containers 12*a* and 12*b*, the latch member 22*a* of container 12*a* is disengaged from the retaining member 24*b* of container 12*b* and is pivoted in a counterclockwise direction (as shown in FIG. 2). The latch member 22*a* of container 12*a* may then be engaged with the retaining member 24*a* of the container 12*a*. A tab 57 may be constructed and arranged to extend from the latch member 22*a* to facilitate the pushing of the latch member 22*a* to engage the latch member 22*a* with the retaining members 24*a* and 24*b* and the pulling of the latch member 22*a* to disengage the latch member 22*a* from the retaining members 24*a* and 24*b*.

In the embodiment shown in FIG. 3, the latch member 22*a* includes an engaging element 58, which takes the form of a recess, that is constructed and arranged to engage with the retaining members 24*a* and 24*b*. An upper periphery portion 60 defines the top of the recess 58 in the latch member 22*a*. A lower periphery portion 62 defines the bottom of the recess 58 in the latch member 22*a*. The lower periphery portion 62 may be constructed and arranged to engage with either an upper groove 66 or a lower groove 68 of the retaining members 24*a* and 24*b*.

As shown in FIG. 3, the retaining member 24*a*, 24*b* includes a lip 64, the upper groove 66, and the lower groove 68. The engaging member 22*a* may be constructed and arranged such that when the engaging member 22*a* is engaged with the upper retaining member 24*a*, the lower periphery portion 62 of the engaging member 22*a* is retained in the lower groove 68 of the retaining member 24*a*. Alternatively, when the engaging member 22*a* of one of the containers 12*a* or 12*b* is engaged with the lower retaining member 24*b* of another one of the containers 12*a* or 12*b* to connect the containers 12*a* and 12*b*, the lower periphery portion 62 may be retained in the upper groove 66 of the retaining member 24*b*.

As shown in FIG. 3, the latch member 22*a* of container 12*b* is in the first position, wherein the latch member 22*a* of container 12*b* is engaged with the upper retaining member 24*a* of container 12*b*. The lower periphery portion 62 of latch member 22*a* of container 12*b* is disposed in the lower groove 68 of the retaining member 24*a* of container 12*b*. In FIG. 3, the latch member 22*a* of container 12*a* is in the second position, wherein the latch member 22*a* is engaged with the lower retaining member 24*b* of container 12*b*. The lower periphery portion 62 of latch member 22*a* of container 12*a* is disposed in the upper groove 62 of the lower retaining member 24*b* of container 12*b*.

To engage the latch member 22*a* of container 12*b* with the upper retaining member 24*a* of container 12*b*, the user may simply pivot the latch member 22*a* downwards in a counterclockwise direction towards the retaining member 24*a*. The lower periphery portion 62 that defines the recess 58 of latch member 22*a* is constructed and arranged to slide against a lower surface of the lip 64 until the lower periphery portion 62 snaps into the lower groove 68, thus engaging the latch member 22*a* with the retaining member 24*a*. To disengage the latch member 22*a* from the retaining member 24*a*, the user may simply pull the latch member 22*a* pivotally upwards in the clockwise direction via the tab 57. As such, the lower periphery portion 62 is removed from the groove 68 and is slid along the lower surface of the lip 64 until the latch member 22*a* is completely disengaged from the retaining member 24*a*.

To engage the latch member 22*a* of container 12*a* with the lower retaining member 24*b* of container 12*b* so that container 12*a* is connected to container 12*b*, the user may simply pivot the latch member 22*a* upwards in a clockwise direction towards the retaining member 24*b*. As the latch member 22*a* is pushed against the retaining member 24*b*, the lower periphery portion 62 of the recess 58 slides against an upper surface of the lip 64 until the lower periphery portion 62 snaps into the upper groove 66, thus engaging the latch member 22*a* with the retaining member 24*b*. To disengage the latch member 22*a* from the retaining member 24*b*, the user may simply pull the latch member 22*a* pivotally downwards in the counterclockwise direction via the tab 57. As such, the lower periphery portion 62 is removed from the upper groove 66 and is slid along the upper surface of the lip 64 until the latch member 22*a* is completely disengaged from the retaining member 24*b*. It is contemplated that in some embodiments, the latch member is moveable relative to the container portion 14 via other means. For example, the latch member 22*a* may be constructed and arranged to be slideable between the first and second positions.

In the embodiment shown in FIG. 5, containers 12*a*, 12*b*, and 12*c* are connected via latch members 22*b*, 22*c*, and 22*d*. Latch members 22*b*, 22*c*, and 22*d* are constructed and arranged in the same manner, but are labeled with "b", "c", and "d" to better differentiate among them in the description below. Each container 12*a*, 12*b*, and 12*c* includes the cover 20 and container portion 14. The covers 20 may optionally be removed so that none, one, or two of the containers have covers 20 when the containers 12*a*, 12*b*, and 12*c* are connected. The containers 12*a*, 12*b*, and 12*c* may be similarly constructed and arranged as containers 12*a* and 12*b* shown in FIG. 1.

Figure 6:
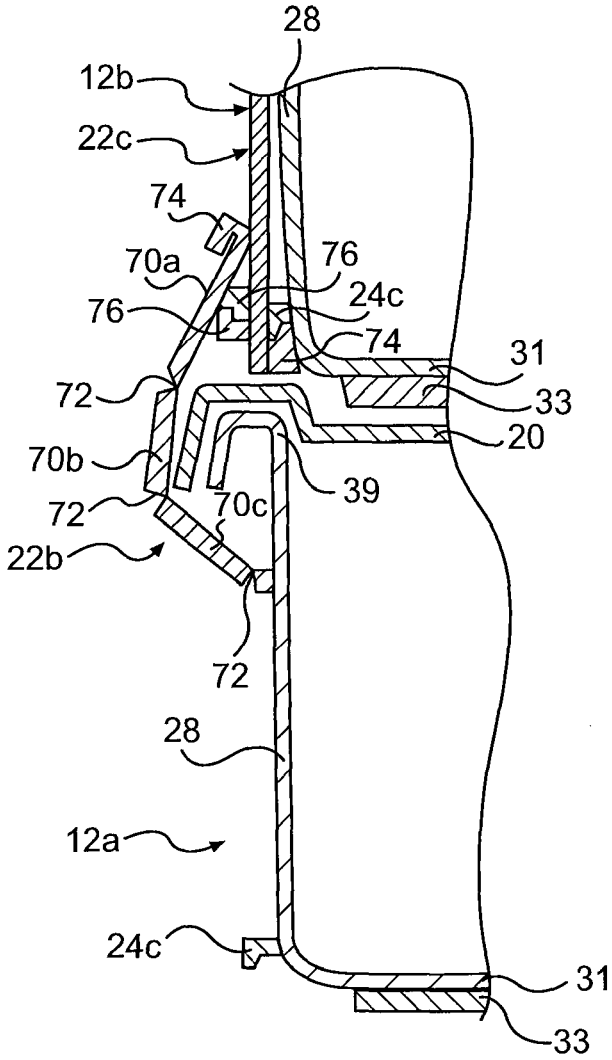
FIG. 6 is a cross-sectional view of the container storage assembly in accordance with the embodiment of FIG. 5.

In the embodiment shown in FIG. 6, the latch member 22*b*, which is pivotally attached to container 12*a*, is used to connect container 12*a* to container 12*b*. Although FIG. 6 only shows the connection between containers 12*a* and 12*b*, the description below may also be generally applicable to the connection between containers 12*b* and 12*c*. When the container 12*b* is connected to container 12*a*, the feet 33 of container 12*b* may be disposed against the cover 20 of container 12*a*. In some embodiments, the bottom surface 31 of container 12*b* may be disposed against the cover 20 of container 12*a* when container 12*b* is connected to container 12*a*. In embodiments where the cover 20 of container 12*a* is removed, at least a portion of the bottom wall 31, the back wall 26, the left wall 28, the front wall 30, and the right wall 32 of container 12*b* may be disposed on the top portions 39 of the back wall 26, the left wall 28, the front wall 30, and the right wall 32 of container 12*a*.

As shown in FIG. 6, the latch member 22*b* includes a plurality of segments 70*a*, 70*b*, and 70*c* connected via living hinges 72. The segments 70*a*, 70*b*, and 70*c* may optionally be connected using hinges, pins, screws, fastenings, bolts, or any other connecting mechanism. It is contemplated that the number of segments may vary.

In this embodiment, the latch member 22*b* or 22*c* may be pivoted between the first position, where the latch member 22*b* or 22*c* engages a retaining member or latch receiving portion 24*c* to inhibit pivotal movement of the latch member 22*b* or 22*c* away from the first position, and the second position, where the latch member 22*b* or 22*c* of one of the containers 12*a* and 12*b* engages with a portion of the latch member 22*b* or 22*c* of another one of the containers 12*a* and 12*b* to connect the containers 12*a* and 12*b*. Because the latch member 22*b* or 22*c* may be pivoted to the first position when the latch member 22*b* or 22*c* is not being used to connect one of the containers 12*a* or 12*b* to another one of the containers 12*a* or 12*b*, this results in being able to prevent the latch member 22*b* or 22*c* from hindering use of the containers 12*a* and 12*b* or from getting lost. Another result is the prevention of the latch member 22*b* or 22*c* from accidentally being removed or dislocated from the containers 12*a* and 12*b* when the latch member 22*b* or 22*c* is not being used to connect the containers 12*a* and 12*b*.

As shown in FIG. 6, each of the containers 12*a* and 12*b* may include the retaining member 24*c*, which takes the form of a downwardly facing hook in this embodiment, that is constructed and arranged to engage with the latch member 22*b* or 22*c*. The latch member 22*b* or 22*c* may include an engaging member 74, which takes the form of an upwardly facing right hook in this embodiment when the latch member 22*b* or 22*c* is in the first position, and an engaging member 76, which takes the form of a upwardly facing left hook in this embodiment when the latch member 22*b* or 22*c* is in the first position. The engaging member 74 of the latch member 22*b* or 22*c* may be constructed and arranged to engage with the retaining member 24*c* when the latch member 22*b* or 22*c* is in the first position. The engaging member 74 of the latch member 22*b* of container 12*a* may also be constructed and arranged to engage with the retaining member 24*c* of container 12*b* when the latch member 22*b* is in the second position.

In the embodiment shown in FIG. 5, the retaining members 24*c* and the latch members 22*b*, 22*c*, and 22*d* are located on the left wall 28 and the right wall 32 of the container portion 14. However, the retaining members 24*c* and the latch members 22*b*, 22*c*, or 22*d* may be positioned at other locations, such as, for example, the back wall 26 and the front wall 30. It is contemplated that there may be retaining members 24*c* and latch members 22*b*, 22*c*, or 22*d* on all or any combination of the back wall 26, left wall 28, front wall 30, and right wall 32.

Referring back to FIG. 6, the latch member 22*c* of container 12*b* is in the first position such that the upwardly facing right hook 74 of the latch member 22*c* is engaged with the retaining member 24*c* of container 12*b*. The engaging member 76 of the latch member 22*c* is facing upwards and is constructed and arranged to engage with the engaging member 76 of the latch member 22*b*. As shown in FIG. 6, when the latch member 22*b* is in the second position, the engaging member 76 of the latch member 22*b* is facing downwards and is engaged with the upwardly facing engaging member 76 of the latch member 22*c*. In the second position, the engaging member 74 of the latch member 22*b* is facing away from the container 12*b* when it is not being used to engage with any portions of containers 12*a* and 12*b*.

When the latch member 22*b* or 22*c* of a first of the containers 12*a* and 12*b* is not being used to connect another one of the containers 12*a* and 12*b* above the first container 12*a* or 12*b*, the user may simply pull the latch member 22*b* or 22*c* of the first container 12*a* or 12*b* downwards so that the engaging member 74 is engaged with the retaining member 24*c* of the first container 12*a* or 12*b*. In the embodiment shown in FIG. 6, the latch member 22*c* is in the first position such that the engaging member 74 of the latch member 22*c* is engaged with the retaining member 24*c*. In this embodiment, to connect containers 12*a* and 12*b*, the user may simply pivot the latch member 22*b* upwardly in the clockwise direction and then engage or hook engaging member 76 of the latch member 22*b* to engaging member 76 of the latch member 22*c*. The engaging member 74 of the latch member 22*b* may be constructed and arranged to facilitate the lifting of the latch member 22*b* to the second position. To disengage the engaging member 76 of the latch member 22*b* from the engaging member 76 of the latch member 22*c*, the user may simply pull the latch member 22*b* in an upwards direction until the engaging member 76 of the latch member 22*b* is removed from the engaging member 76 of the latch member 22*c*. The user may then pivot the latch member 22*b* downwards in a clockwise direction to move the latch member 22*b* to the first position.

In the embodiment of FIG. 6, if the latch member 22*c* is being used to latch container 12*c* to the top of container 12*b*, the latch member 22*b* may be engaged with the retaining member 24*c* of the container 12*b* to connect the containers 12*a* and 12*b* together. To accomplish this, the user may further rotate latch member 22*b* in the clockwise direction to engage engaging member 74 of the latch member 22*b* with the retaining member 24*c* of the container 12*b*. For example, to engage engaging member 74 of the latch member 22*b* with the retaining member 24*c* of container 12*b*, the user may position the engaging member 74 to face upwardly so as to hook into and engage with the downwardly facing retaining member 24*c* of container 12*b*. To disengage the engaging member 74 of the latch member 22*b* from the retaining member 24*c* of container 12*b*, the user may simply push the engaging member 74 in a downwards direction until the engaging member 74 is unhooked from the retaining member 24*c*. The user may then pivot the latch member 22*b* downwards in a counterclockwise direction to move the latch member 22*b* towards the first position.

Container 12*b* may be connected to container 12*c* using latch members 22*c* and 22*d* in a similar manner as described previously with respect to the latch members 22*b* and 22*c* of containers 12*a* and 12*b*, respectively. It is contemplated that additional containers may be connected to the containers 12*a*, 12*b*, and 12*c* in a similar manner.

Figure 7:
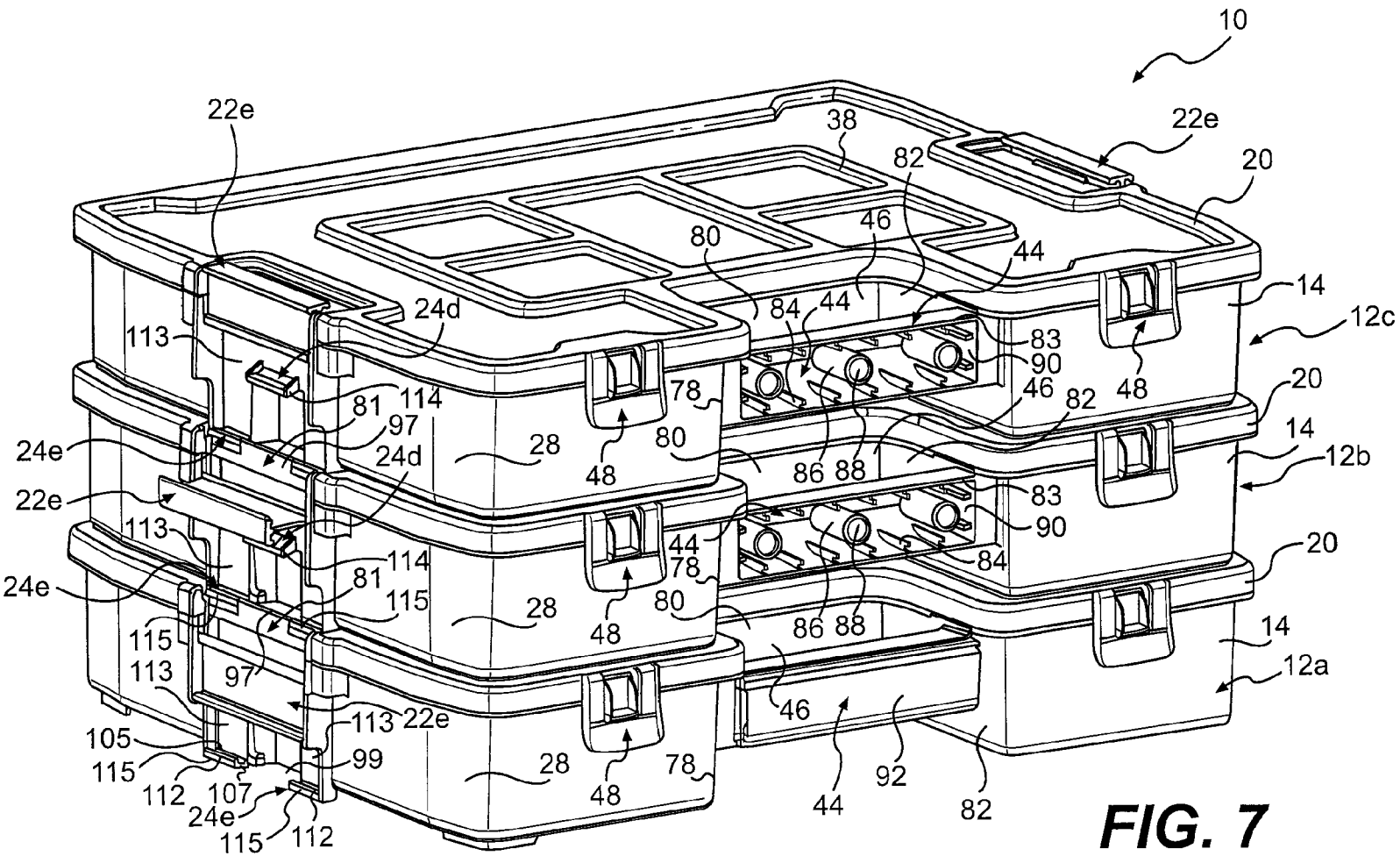
FIG. 7 is a perspective front view of the container storage assembly in accordance with another embodiment of the present invention.

As shown in FIG. 7, in another embodiment, the container system 10 has a plurality of containers 12*a*, 12*b*, and 12*c* that are constructed and arranged to be connected together. Each of the containers 12*a*, 12*b*, and 12*c* includes the latch member 22*e* that when in the latched position (or the second position), is positioned to a) secure the cover in the closed position and b) connect one of the containers 12*a*, 12*b*, and 12*c* to another one of the containers 12*a*, 12*b*, or 12*c*. Specifically, in the embodiment shown in FIG. 7, the pivotal latch member 22*e* can be pivoted between the first position (or unlatched position), where the latch member 22*e* engages the upper retaining member or upper latch receiving portion 24*d* to inhibit pivotal movement of the latch member 22*e*, and the second position, where the latch member 22*e* engages with a) an engaging member 81 (see FIG. 9) of its associated cover 20 to latch the cover 20 thereon and/or b) a lower retaining member or latch receiving portion 24*e* of another one of the containers 12*a*, 12*b*, or 12*c* to connect the containers 12*a*, 12*b*, 12*c*. In other embodiments, no retaining member is provided to engage with the latch member 22*e* when the latch member 22*e* is in the unlatched position. Many of the components of the embodiment shown in FIG. 7 are similar to the components of the embodiment shown in FIG. 1, and thus will be labeled in a similar manner. In the embodiment shown in FIG. 7, each container 12*a*, 12*b*, and 12*c* includes the cover 20 and container portion 14. The covers 20 may optionally be removed so that none, one, or two of the containers have covers 20 when the containers 12*a*, 12*b*, and 12*c* are connected. The containers 12*a*, 12*b*, and 12*c* may be similarly constructed and arranged as containers 12*a* and 12*b* shown in FIG. 1.

In the embodiment shown in FIG. 7, a depression 46 is formed in the front of the container portion 14. In this embodiment, a left portion 78, a back portion 80, and a right portion 82 define the U-shaped depression 46. The depression 46 may take any other shapes or forms, and may be constructed and arranged to receive the handle 44. In this embodiment, the handle 44 extends between the left portion 78 and the right portion 82. The handle 44 may be hollow and may include ribs 84 deployed along the interior surface thereof. The ribs 84 may provide reinforcement for the handle 44 when the handle 44 is grasped by the user. In this embodiment, the handle 44 includes a back portion 83 having projections 86 with recesses 88 provided therein. The projections 86 may be constructed and arranged to extend generally perpendicularly relative to the back portion 83 in an interior space 90 of the back portion 83. The recesses 88 of the projections 86 may be constructed and arranged to receive projections (not shown) located on a front plate 92. Accordingly, the back portion 83 and the front plate 92 may be connected so as to form the handle 44. The handle 44 may optionally be made of plastic, metal, wood, rubber, other materials known in the art, or any combination thereof. Rubber, foam, or other anti-slip materials may be provided on the surface thereof so as to facilitate the grasping of the handle 44. In one embodiment, the back portion 83 of the handle 44 may be made from a plastic material and the front portion 92 of the handle 44 may be made from a rubber material.

Figure 9:
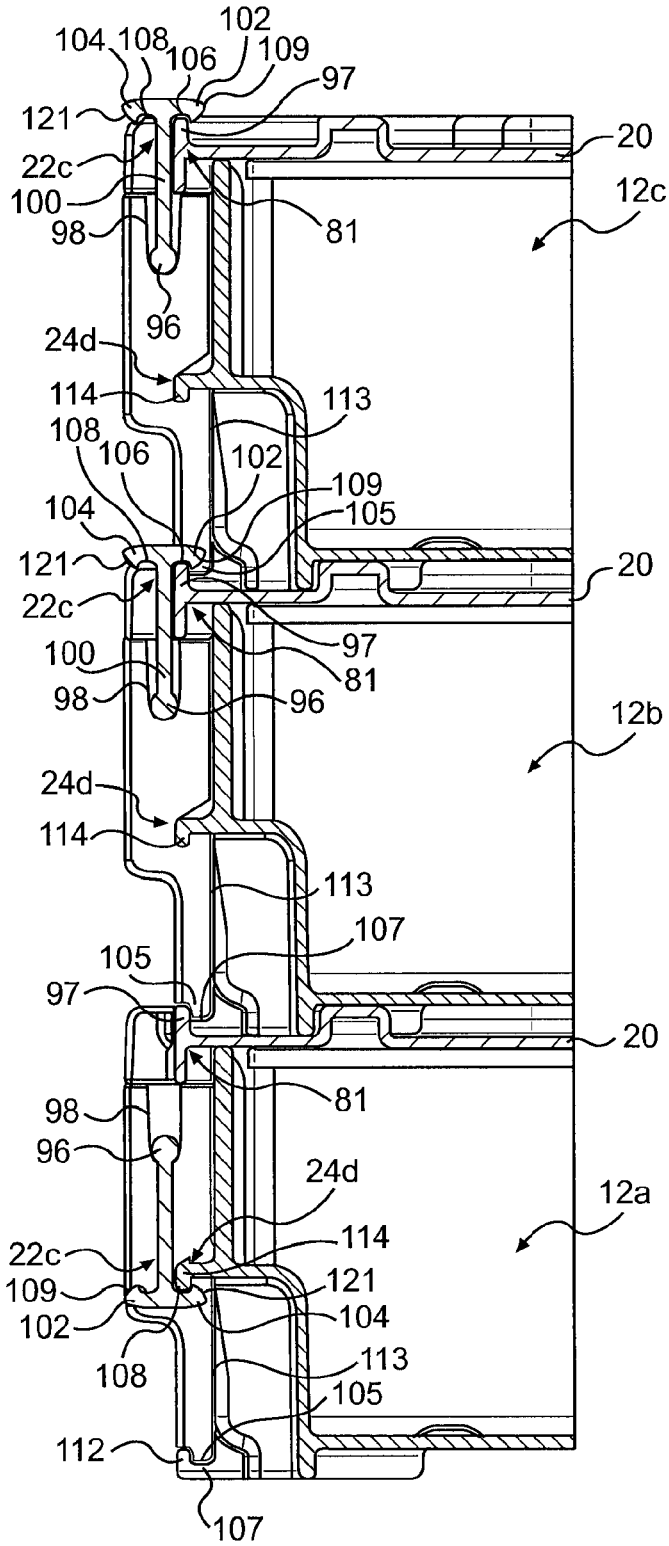
FIG. 9 is a cross-sectional view of the container storage assembly in accordance with the embodiment of FIG. 7.

As shown in FIG. 9, the pivotal latch member 22*e* may be pivotally connected to the container portion 14 of each container 12*a*, 12*b*, and 12*c*. Specifically, in one embodiment, the latch member 22*e* has a curved cylindrical end 96 that is received in a groove 98 with a curved surface so that the cylindrical end 96 may pivot within the groove 98. It is contemplated that the latch member 22*e* may also be connected to the container portion 14 using pins, hinges, or other connecting mechanisms that enable pivotal movement. In one optional embodiment, the latch member 22*e* may optionally be removable from the container portion 14.

In the embodiment shown in FIG. 9, the latch member 22*e* of container 12*c* is in the second position (or latched position), where the latch member 22*e* is engaged with the engaging member 81 of its associated cover 20 to latch the cover 20 to the container portion 14. The latch member 22*e* of container 12*b* is also in the second position, where the latch member 22*e* is engaged with the engaging member 81 of the cover 20 to latch the cover 20 to the container portion 14 and with the lower retaining member 24*e* of the container 12*c* to latch the containers 12*b* and 12*c* together. In contrast, the latch member 22*e* of container 12*a* is in the first position (or unlatched position), where the latch member 22*e* is engaged with the upper retaining member 24*d* so as to inhibit pivotal movement of the latch member 22*e* away from the first position.

In the embodiment shown in FIG. 9, each latch member 22*e* has a generally T-shaped cross-section (as shown), with an elongated body 100 and two fingers 102, 104 extending in opposite directions from one end of the body 100. A groove 106 may be formed at an area between the finger 102 and the body 100 and may be constructed and arranged to receive the lower retaining member 24*e* and/or the engaging member 81 of the cover 20 when the latch member 22*e* is in the second position. Similarly, a groove 108 may be formed at an area between the finger 104 and the body 100 and may be constructed and arranged to receive the upper retaining member 24*d* when the latch member 22*e* is in the first position. It is contemplated that the user may pull or push on the fingers 102, 104 of the latch member 22*e* to pivot the latch members 22*e* between the first and second positions.

In one embodiment, each lower retaining member or lower latch receiving portion 24*e* takes the form of two portions 115 with an opening 99 provided between the two portions 115, as shown in FIG. 7. The two portions 115 that form the lower retaining member 24*e* are identical and thus the descriptions below with regard to the lower retaining member 24*e* will be considered to apply to both portions. In the embodiment shown in FIG. 7, an outer wall 113, to which the upper retaining member 24*d* is attached, extends parallel with respect to the left wall 28. In some embodiments, the outer wall 113 may form a part of the side wall 28.

The lower retaining member 24*e* and the engaging member 81 of the cover 20 are constructed and arranged such that when one of the containers 12*a*, 12*b*, or 12*c* is stacked on top of another one of the containers 12*a*, 12*b*, or 12*c*, the engaging member 81 of the cover 20 is positioned between the two portions 115 of the lower retaining member 24*e* of the upper container 12*a*, 12*b*, or 12*c* (within the opening 99). For example, as shown in FIG. 7, the engaging member 81 of the cover 20 of container 12*a* is positioned between the two portions 115 of the lower retaining member 24*e* of container 12*b*. In the embodiment shown in FIG. 7, the engaging member 81 of the cover 20 takes the form of an elongated lip 97. As such, this enables the latch member 22*e* of the lower container 12*a*, 12*b*, or 12*c* to engage with both a) the engaging member 81 of its associated cover 20 and b) the lower retaining member 24*e* of the upper container 12*a*, 12*b*, or 12*c*, which will be described in more detail later.

In one embodiment, the engaging member 81 of the cover 20 includes the lip 97 that is constructed and arranged to engage with the groove 106 of the latch member 22*e* when the latch member 22*e* is in the second position. In the embodiment shown in FIG. 9 (see container 12*a*), the lower retaining member 24*e* includes a lip 112 that is constructed and arranged to engage with the groove 106 of the latch member 22*e* when the latch member 22*e* is in the second position. Similarly, the upper retaining member 24*d* includes a lip 114 that is constructed and arranged to engage with the groove 108 of the latch member 22*e* when the latch member 22*e* is in the first position. As shown in FIG. 7, the lip 114 of each container 12*a*, 12*b*, 12*c* extends in a downward direction parallel to the side wall 28 of each container 12*a*, 12*b*, 12*c*.

As shown in FIGS. 7 and 9 and which can be seen with regard to container 12*a*, the lower retaining member 24*e* includes a connecting portion 107 that connects the outer wall 113 with the lip 112. The outer wall 113, connecting portion 107, and the lip 112 define a recess 105 that is constructed and arranged to receive a portion of the finger 102 when the latch member 22*e* is in the second position. As shown in FIG. 9, the lip 112 of the lower retaining member 24*e* of containers 12*a*, 12*b*, 12*c* extends upwardly in a direction perpendicular to the connecting portion 107.

As mentioned above, the engaging member 81 of the cover 20 includes the elongated lip 97. As shown in FIG. 7 and which can be seen with regard to containers 12*a* and 12*b*, when the cover 20 of container 12*a* is positioned on top thereof, the lip 97 of the cover 20 is aligned with the lip 112 of the lower latch member 24*e* of container 12*b*. This enables the latch member 22*e* of container 12*a* to latch the 1) cover 20 of container 12*a* thereto and b) connect container 12*a* with container 12*b*. Containers 12*b* and 12*c* may also have such configurations so that they may be connected in a similar manner.

To engage the latch member 22*e* of container 12*a*, 12*b*, or 12*c* with the upper retaining member 24*d* located thereon, the user may simply pivot the latch member 22*e* downwards in a counterclockwise direction (as seen in FIG. 9) towards the retaining member 24*d*. In the embodiment shown in FIG. 9 and which will be described with regard to container 12*a*, the finger 104 of the latch member 22*e* of container 12*a* may be pushed against the lip 114. Specifically, a front surface 121 of the finger 104 may be pushed against an outer surface of the lip 114 until the resiliency of the lip 114 and the finger 104 enables the lip 114 to snap into the groove 108 and thus be retained by the groove 108. As such, the latch member 22*e* is inhibited from movement away from this first position.

To disengage the latch member 22*e* from the upper retaining member 24*d*, the user may simply pull the latch member 22*e* pivotally upwards in the clockwise direction (as viewed in FIG. 9) via the finger 102 of the latch member 22*e*. The resiliency of the lip 114 and the finger 104 enables the lip 114 of the upper retaining member 24*d* to snap out of the groove 108 of the latch member 22*e*. As such, the upper retaining member 24*d* is no longer engaged with the latch member 22*e*. All of the containers 12*a*, 12*b*, 12*c* may optionally have such configurations.

To engage the latch member 22*e* of container 12*b* with the lower retaining member 24*e* of container 12*c*, as shown in the embodiment of FIG. 7, the user may simply pivot the latch member 22*e* upwards in a clockwise direction (as viewed in FIG. 9) towards the retaining member 24*e*. In the embodiment shown in FIG. 9 and which will be described with regard to containers 12*b* and 12*c*, the finger 102 of the latch member 22*e* of container 12*b* may be pushed against the lip 112 of the lower retaining member 24*e* of container 12*c*. In this Figure, the lip 112 is obstructed from view by lip 97. However, lip 112 of containers 12*b* and 12*c* have the same construction and arrangement as lip 112 of container 12*a*. Specifically, a front surface 109 of the finger 102 may be pushed against an outer surface of the lip 112 until the resiliency of the lip 112 and the finger 102 enables the lip 112 to snap into the groove 106 and thus be retained by the groove 106. In this position, as can be seen with respect to containers 12*b* and 12*c*, a portion of the finger 102 of the latch member 22*e* of container 12*b* is received within the recess 105 of the container 12*c*. As such, the latch member 22*e* is inhibited from movement away from this second position. Any one of the containers 12*a*, 12*b*, and 12*c* may be connected to another one of the containers 12*a*, 12*b*, or 12*c* in a similar manner. In particular, the container 12*c* may be connected to container 12*b* in a similar manner as described above.

To disengage the latch member 22*e* from the lower retaining member 24*e*, the user may simply pull the latch member 22*e* pivotally downwards in the counterclockwise direction via the finger 104 of the latch member 22*e*. Accordingly, the lip 112 of the lower retaining member 24*e* is removed from the groove 106. As such, the finger 102 is removed from the recess 105 of the lower retaining member 24*e*, and the lower retaining member 24*e* is no longer engaged with the latch member 22*e*.

The latch member 22*e* may also engage with the engaging member 81 of the cover 20 in a similar manner as the aforementioned description. Specifically, to engage the latch member 22*e* of container 12*b* with the lip 97 of the engaging member 81 of its associated cover 20, the user may simply pivot the latch member 22*e* upwards in a clockwise direction towards the engaging member 81. As such, the finger 102 of the latch member 22*e* is pushed against the lip 97 of the engaging member 81 until the resiliency of the lip 97 and the latch member 22*e* enables the lip 97 to snap into the groove 106 of the latch member 22*e*. The lip 97 is thus retained in the groove 106 and the latch member 22*e* is engaged with the engaging member 81 of the cover 20. As mentioned above, when the cover 20 is positioned on top of a first container 12*a*, 12*b*, or 12*c*, the engaging member 81 of the cover 20 is positioned between the two portions 115 of the latch member 22*e* of the second container 12*a*, 12*b*, or 12*c* located above the first container 12*a*, 12*b*, or 12*c* (see, for example, containers 12*b* and 12*c* in FIG. 7). Therefore, the latch member 22*e* of the first container 12*a*, 12*b*, or 12*c* may engage its associated cover 20 as well as another container 12*a*, 12*b*, or 12*c* located above the first container 12*a*, 12*b*, or 12*c*.

To disengage the latch member 22*e* from the engaging member 81, the user may simply pull the latch member 22*e* pivotally downwards in the counterclockwise direction via the finger 104 of the latch member 22*e*. Accordingly, the lip 97 of the engaging member 81 is removed from the groove 106 and the engaging member 81 is no longer engaged with the latch member 22*e*.

The latch member 22*e*, the upper retaining member 24*d*, and the lower retaining member 24*e* may optionally have other configurations. Just for example, the latch member 22*e* may have a loop configuration that engages with a hook configuration of the upper retaining member 24*d* and the lower retaining member 24*e*. The configuration of the latch member 22 and the retaining members 24*e*, 24*d* may optionally be interchanged. In one embodiment, the latch member 22*e* may include an opening that receives a protrusion of the retaining members 24*d*, 24*e*. In one embodiment, the latch member 22*e* and the retaining members 24*d*, 24*e* may be engaged using buckle configurations. In one embodiment, the latch member 22*e* and the retaining members 24*d*, 24*e* may be engaged using snap-fit connections.

Figure 10:
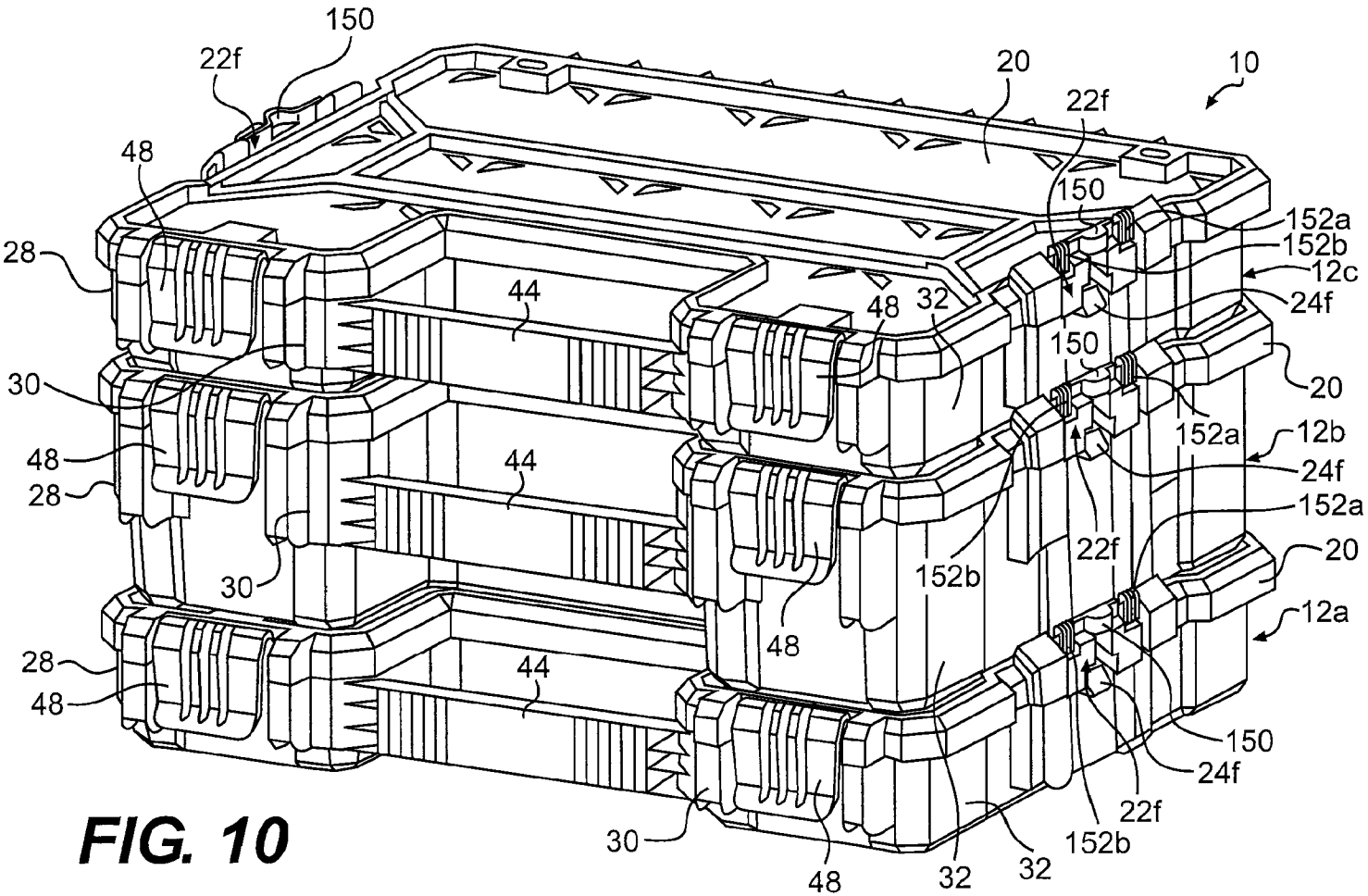
FIG. 10 is a perspective view of the container storage assembly in accordance with another embodiment of the present invention.

As shown in FIG. 10, in another embodiment, the container system 10 has a plurality of containers 12*a*, 12*b*, and 12*c* that are constructed and arranged to be connected or latched together. Many of the components of the embodiment shown in FIG. 10 are similar to the components of the embodiment shown in FIG. 7, and thus will be labeled in a similar manner.

Each of the containers 12*a*, 12*b*, and 12*c* includes a latch member 22*f* that is movable between a first position and a second position. A retaining member or latch receiving portion 24*f* on the container portion 32 is constructed and arranged to engage with the latch member 22*f*. In the first position, the latch member 22*f* engages the retaining member 24*f* to inhibit movement of the latch member 22*f* away from the first position. The latch member 22*f*, when in the second position, is positioned to be able to engage with the container portion 32 of the at least one other container 12*a*, 12*b*, 12*c*, that is above it, to connect the container 12*a*, 12*b*, 12*c* to the above at least one other container 12*a*, 12*b*, 12*c*. The latch member 22*f* is pivotally movable in a clockwise and counterclockwise manner and can be pivoted upwards to the second position to engage the container portion 32 of the at least one other container 12*a*, 12*b*, 12*c*. The latch member 22*f* can also be pivoted downwards to the first position to engage the retaining member 24*f* to inhibit movement of the latch member 22*f* away from the first position. In one embodiment, the latch member 22*f* may be pivoted along pivot axis A (see FIG. 12*a*) between the first and second positions. The latch member 22*f* may be pivotally connected to the container portion 32 at a pivoting portion 156 of the latch member 22*f*. In this embodiment, each containers 12*a*, 12*b*, 12*c* includes two latch members 22*f* and two retaining members 24*f* associated with the latch members 22*f*. In embodiments having two (first and second) latch members 22*f*, the latch members 22*f* may be provided on the left side 28 and right sides 32, respectively, of the container portions 12*a*, 12*b*, 12*c*. The latch members 22*f* of each container 12*a*, 12*b*, 12*c* may be constructed and arranged in a similar manner as one another. However, it should be appreciated that the location and number of latch members 22*f* may vary in other embodiments.

In the embodiment shown in FIG. 10, the handle 44 is located on or near the front side 30 of the container portion 32 between the cover latches 48 (two are shown in this embodiment). Grooves, a layer of elastomeric material, or other materials/structures may be provided on the handle 44 to facilitate grasping thereof. Each cover latches 48 is pivotally connected to the cover 20 and engages a latch engaging element (not shown) on the container portion 32 to lock the cover 20 to the container portion 32. In this embodiment, the cover latches 48 are separate from the latch members 22*f*. It is contemplated that the location and number of cover latches 48 may vary in other embodiments.

In the illustrated embodiment, each latch members 22*f* optionally includes an upper portion 150 having an arcuate shape and that is constructed and arranged to facilitate movement of the latch member 22*f* between the first and second positions. The user may grasp the upper portions 150 when pivoting the latch member 22*f* between the first and second positions. The upper portion 150 may extend between extending portions 152*a*, 152*b* of the latch member 22*f*. The extending portions 152*a*, 152*b* may be provided with grooves or other structures thereon.

Figure 11A:
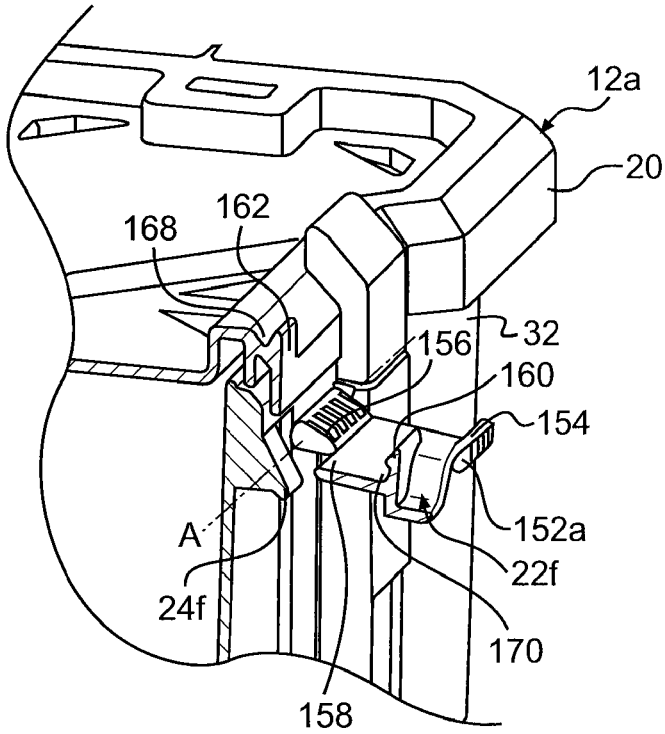
FIGS. 11*a*-11*b* are cross-sectional views of a cover of the container in the unlatched and latched positions, respectively.

FIG. 11*a* shows a cross sectional view of one half portion of the latch member 22*f*. The other half portion of the latch member 22*f* not shown in this Figure may be the mirror image of the portion shown in this Figure to form the whole latch member 22*f* (see FIG. 10). In this embodiment, the extending portion 152*a* includes a container engaging portion 154 constructed and arranged to engage with a lower latch receiving portion 24*g* (see FIG. 12*a*) of another container 12*a*, 12*b*, 12*c* to connect the containers 12*a*, 12*b*, 12*c* together. The other half portion of the latch member 22*f*, which includes the extending portion 152*b*, may be constructed and arranged in a similar manner as the half portion of the latch member 22*f* shown in FIG. 11*a*. Thus, there may be a separate container engaging portion 154 on the extending portion 152*b* that is constructed and arranged to engage with a separate lower latch receiving portion 24*g* on the other container 12*a*, 12*b*, 12*c*.

In the illustrated embodiment, an optional cover latching portion 160 is provided on the latch member 22*f* and may be constructed and arranged to engage with a latch engaging portion 162 on the cover 20 to latch or secure the cover 20 in the closed position. The cover latching portion 160 and the container engaging portion 154 may be arranged to be spaced apart on the latch member 22*f*. For example, as shown in FIG. 11*a*, the cover latching portion 160 may be positioned closer than the container engaging portion 154 to the pivoting portion 156 of the latch member 22*f*.

Figure 12A:
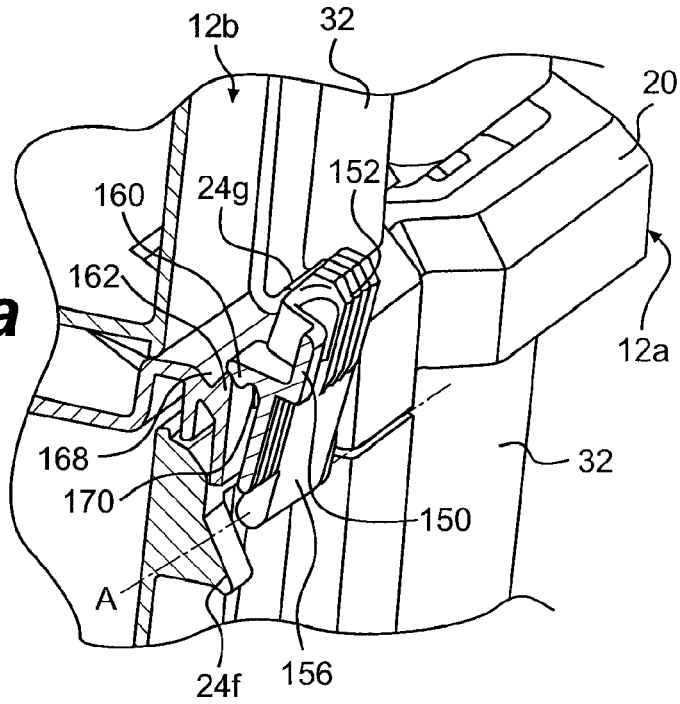
FIGS. 12*a*-12*b* are cross-sectional views of the container unlatched from another container and the container latched with another container, respectively.
Figure 12B:
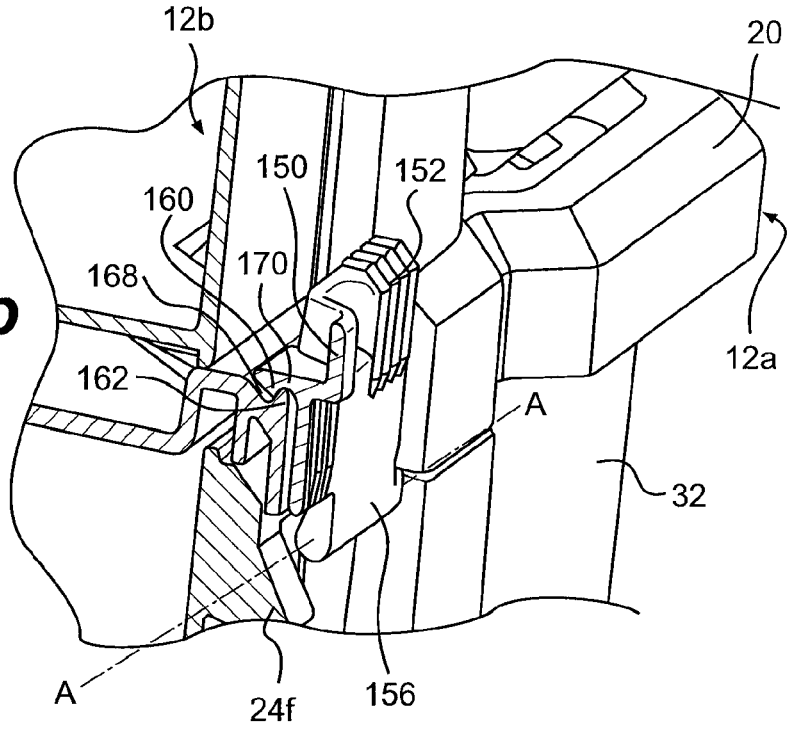

In one embodiment, as shown in FIG. 12*b*, when the cover latching portion 160 of the latch member 22*f* is engaged with the latch engaging portion 162 of the cover 20, the cover latching portion 160, which may take the form of a protrusion, is received in a groove 168 of the cover 20 and the latch engaging portion 162, which may take the form of a protrusion, is received in a groove 170 of the latch member 22*f*. Thus, to lock the cover 20 to the container portion 32 using the latch member 22*f*, the user may simply pivot the latch member 22*f* upwards in the counterclockwise direction along the pivot axis A from the position shown in FIG. 11*a* so that the cover latching portion 160 of the latch member 22*f* is engaged with the latch engaging portion 162 of the cover 20. It is contemplated that the other half portion of the latch member 22*f* not shown in FIG. 11*a* may also have such similar structures but may be arranged in a mirror image manner.

Figure 11B:
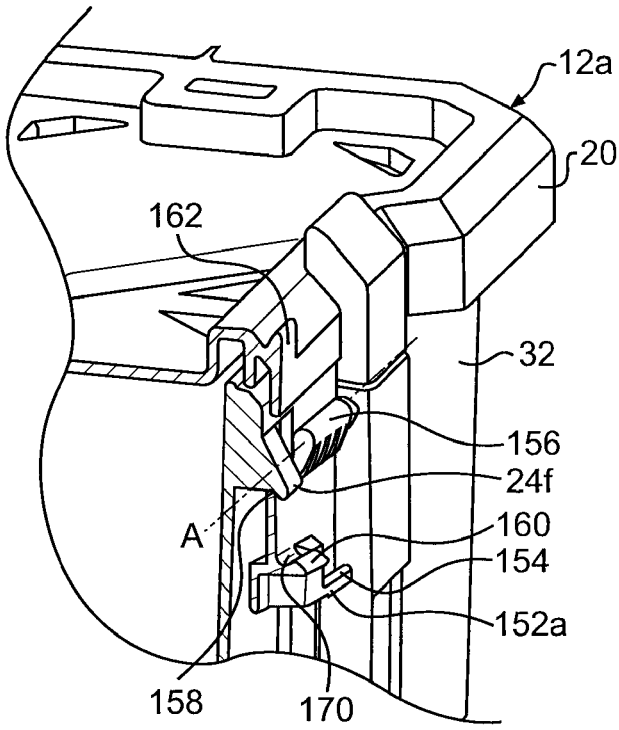

Referring back to FIG. 11*a*, the latch member 22*f* may include a retaining portion 158, which takes the form of a ledge in this embodiment, formed on a lower portion of the latch member 22*f* near the pivoting portion 156. The retaining portion 158 may be constructed and arranged to engage with the retaining member 24*f*, which takes the form of hook-shaped downward facing structure in this embodiment, when the latch member is in the first position (as shown in FIG. 11*b*). Thus, to move the latch member 22*f* to the first position, the user may simply pivot the latch member 22*f* downwards in the clockwise direction from the position shown in FIG. 11*a* so that the retaining portion 158 is engaged with the retaining member 24*f*, as shown in FIG. 11*b*.

FIG. 12*a* shows a cross-sectional view of the container 12*a* unlatched from another container 12*b*. As shown in the illustrated embodiment, when the container 12*b* is stacked on the container 12*a*, the lower latch receiving portion 24*g* of the container 12*b* may be positioned at an elevated height relative to the latch engaging portion 162 of the cover 20 of the container 12*a*. Thus, the cover latching portion 160 and the container engaging portion 154 are positioned on the latch member 22*f* to accommodate the different vertical positioning of the lower latch receiving portion 24*g* of the container 12*b* and the latch engaging portion 162 of the cover 20. Accordingly, when the latch member 22*f* is pivoted upwards in the counterclockwise direction to the second position along pivot axis A from the position shown in FIG. 11*a*, the cover latching portion 160 of the latch member 22*f* may be engaged with the latch engaging portion 162 of the cover 20, and the container engaging portion 154 of the latch member 22*f* may be engaged with the lower latch receiving portion 24*g* to 1) latch the cover 20 to the container 12*a* and to 2) connect the container 12*a* to the other container 12*b*, as shown in FIG. 12*b*. Any combination of at least portions of the latch member 22*f*, the latch engaging portion 162 of the cover, and the lower latch receiving portion 24*g* may be made of resilient materials (e.g., plastic) that enable the structures to flex during latching/unlatching. To move the latch member 22*f* to the first position, the user may simply pivot the latch member 22*f* downwards in the clockwise position along the pivot axis A to disengage the latch member 22*f* from the cover 20 and the other container 12*b* and to engage the latch member 22*f* with the lower latch receiving portion 24*g*.

It is contemplated that the other latch members 22*f* on the containers 12*a*, 12*b*, 12*c* may be constructed and arranged in a similar manner as the latch member 22*f* described above and may operate in a similar manner. It should be appreciated that although the latch members 22*f* described above may be pivoted between the first and second positions, it is contemplated that in other embodiments, the latch members 22*f* may be moved in other ways between the first and second positions. That is, there may be one or any combination of movements such as sliding, pivoting, rotating, or other actions, to move the latch member 22*f* between the first and second positions.

In some embodiments, the containers 12*a*, 12*b*, or 12*c* have latch members 22*a*, 22*b*, 22*c*, 22*d*, 22*e*, or 22*f* that may be used to lock the cover 20 to the container portion 32 and may also have pivotable cover latches 48 as in the previous embodiments that may be used to lock the cover to the container portion 32.

Although the invention has been described in detail for the purpose of illustration of one or more embodiments, it is to be understood that such detail is solely for that purpose and that the invention is not limited thereto, but, on the contrary, is intended to cover modifications and equivalent arrangements that are within the spirit and scope of the appended claims. In addition, it is to be understood that the present invention contemplates that, to the extent possible, one or more features of any embodiment may be combined with one or more features of any other embodiment.

What is claimed is:

1. A container constructed and arranged to be connected to at least one other container, the container comprising:

a container portion with an opening into an interior space in which articles to be transported can be stored;

a cover for closing the opening;

a latch member movable between a first position and a second position;

a retaining member on the container portion constructed and arranged to engage with the latch member, wherein in the first position the latch member engages the retaining member to inhibit movement of the latch member away from the first position;

wherein the latch member, when in the second position, is positioned to be able to engage with a container portion of at least one other container to connect the container to the at least one other container, wherein the latch member is pivotally movable in a clockwise and counterclockwise manner between the first and second positions, wherein the latch member is pivotable upwards to the second position for engagement with the container portion of the at least one other container, and wherein the latch member is pivotable downwards to the first position for engagement with the retaining member to inhibit movement of the latch member away from the first position.

2. The container of claim 1, wherein the cover is pivotally connected to a rear side of the container portion.

3. The container of claim 1, further comprising a handle located on the container portion.

4. The container of claim 1, wherein the latch member comprises a plurality of living hinges.

5. The container of claim 1, wherein the interior space of the container is divided into a plurality of compartments.

6. The container of claim 1, wherein the latch member is attached to the container by a living hinge.

7. The container of claim 1, wherein the latch member comprises:

a cover latching portion constructed and arranged to engage with the cover to latch the cover to the container portion; and a container engaging portion constructed and arranged to engage with the container of the at least one other container.

8. The container of claim 7, wherein the cover latching portion and the container engaging portion are constructed and arranged to be spaced apart such that the cover latching portion and the container engaging portion are positioned to be vertically and/or horizontally misaligned with respect to one another on the latch member.

9. The container of claim 1, wherein the latch member is a first latch member, and the container further comprises a second latch member movable between a first position and a second position, wherein in the first position the second latch member engages the retaining member to inhibit movement of the second latch member away from the first position, wherein the second latch member, when in the second position, is positioned to be able to engage with a container portion of the at least one other container to connect the container to the at least one other container, wherein the second latch member is pivotally movable in a clockwise and counterclockwise manner, wherein the second latch member can be pivoted upwards to the second position to engage the container portion of the at least one other container, and wherein the second latch member can be pivoted downwards to the first position to engage the retaining member to inhibit movement of the second latch member away from the first position.

10. The container of claim 9, wherein the first and second latch members are located on opposite sides of the container portion.

11. The container of claim 10, wherein in the second position, the first and second latch members each engages the cover of the container and the container portion of the at least one other container.

12. The container of claim 1, further comprising a cover latch on a front side for latching the cover to the container portion.

13. The container of claim 12, wherein the cover latch is separate from the first and second latch members.

14. The container of claim 12, wherein the cover latch is pivotally connected to the cover and engages a latch engaging element on the container portion to lock the cover to the container portion.

15. The container of claim 12, wherein the cover latch comprises resilient material and is configured to engage with a latch engaging element on the container portion to latch the cover to the container portion.

* * * * *